United States Patent [19]

Kuru

[11] 4,313,671

[45] Feb. 2, 1982

[54] METHOD AND APPARATUS FOR CONTROLLING IMAGE DENSITY IN AN ELECTROPHOTOGRAPHIC COPYING MACHINE

[75] Inventor: Hiroshi Kuru, Hachioji, Japan

[73] Assignee: Konishiroku Photo Industry Co., Ltd., Tokyo, Japan

[21] Appl. No.: 28,203

[22] Filed: Apr. 9, 1979

[30] Foreign Application Priority Data

Apr. 14, 1978 [JP] Japan ..... 53-43303

[51] Int. Cl.[3] ..... G03G 15/00

[52] U.S. Cl. ..... 355/14 D; 118/688; 355/3 DD; 355/77

[58] Field of Search ..... 355/14 D, 77, 3 DD, 355/10; 118/688, 689

[56] References Cited

U.S. PATENT DOCUMENTS 3,876,106 4/1975 Powell et al. ..... 355/14 D
4,026,643 5/1977 Bergman ..... 355/14 D
4,050,806 9/1977 Miyakawa et al. ..... 355/10 X
4,082,445 4/1978 Steiner ..... 355/14 D

*Primary Examiner*—Richard L. Moses
*Attorney, Agent, or Firm*—Bierman & Bierman

[57] ABSTRACT

A method of controlling image density in an electrophotographic copying machine includes operating a first detector to measure the density of a blank region on a photosensitive member, operating a second detector to measure the density of a reference toner image formed on a portion of the blank region, comparing the measured densities of the blank region and the reference toner image, and controlling the density of a developed image of an original in accordance with the results of the comparison. An apparatus in accordance with the invention includes a pair of optical density detecting sensors positioned in opposition to the photosensitive member and in juxtaposition to each other in the direction transverse to the direction of movement of the member.

3 Claims, 6 Drawing Figures

METHOD AND APPARATUS FOR CONTROLLING IMAGE DENSITY IN AN ELECTROPHOTOGRAPHIC COPYING MACHINE

BACKGROUND OF THE INVENTION

The present invention relates to a method of detecting image density in an electrophotographic copying machine and an apparatus for carrying out the method.

In an electrophotographic copying machine, control of toner density or concentration in a developer comprising toner particles and carrier particles is required to produce a copied image having a constant and predetermined image density. For this purpose, there have been proposed various methods of measuring the density of the toner image formed on a photosensitive member in accordance with the copying operation. In one method, a patch having a preselected optical density is attached to a copy board of the copying apparatus, the board comprising a member or plate on which an original to be copied is placed during exposure to light. A toner image of the patch is formed at a preselected region on a drum having a photo-sensitive member or layer, the density of the patch toner image then being measured by use of a sensor for detecting the density.

However, this density measuring method exhibits drawbacks in controlling the toner image density of the original to be copied. For example, the sensor inherently exhibits uneven sensitivity, and additionally is not stable with respect to its operating characteristics on changes of temperature. Further, because the sensor is usually located at an intermediate position between the developing station and the cleaning station in the vicinity of the photo-sensitive surface of the drum, the sensor is very susceptible to contamination by the toner particles. For these reasons, the output signal produced by the sensor does not represent the actual toner density with a reasonable accuracy. In other words, although the density of the patch toner image may actually remain unchanged, the output signal voltage of the sensor will be progressively lowered as though the toner density or concentration were decreased. In particular, in the case of a copying machine in which the sensor is also used for detecting the possible occurrence of jamming of the copy sheets, the sensor is subjected to considerable contamination by the toner particles since the sensor is disposed near to the cleaning station having cleaning means such as a brush. Thus, an erroneous density signal is more likely to be generated. Moreover, variations in the surface conditions of the photo-sensitive drum will exert adverse influences on the output signal of the sensor, providing obstacles in performing an accurate measurement of toner density.

As attempts to eliminate such disadvantages as are described above, it has been heretofore known to adjust the individual sensors, readjust the sensors for every exchange of the photo-sensitive drum, cyclically clean the sensor and/or provide a temperature compensation means in the measuring circuit. However, with all of the measures described above, there still exists difficulty in satisfactorily correcting the density signal. In particular, it is impossible to effect required corrections at the right times.

The present invention teaches sensing of the optical density of the surface of a photo-sensitive drum at a blank region in which no toner image is formed preferably in addition to the detection of a patch toner image density. When the patch toner image density is detected, both the densities are constantly compared with each other, to thereby effect control of constant toner density by compensating in a satisfactory manner any error components appearing in the output signal from the sensors; such errors are ascribable to unevenness in sensitivity of the sensor, variations in the sensor characteristics as a function of temperature, contaminations by toner particles, variations in the surface condition of the photo-sensitive drum, or like factors.

SUMMARY OF THE INVENTION

In accordance with the invention, a patch is preferably provided outside image areas to form a reference toner image in a blank region on a photosensitive member. The density of the reference toner image formed in the blank region in which no image of an original to be copied is formed is measured together with the density of the blank region outside of the reference toner image, to thereby correct the density of the toner image based upon the density of the blank region. In a preferred embodiment of the invention, a pair of optical density detecting sensors are disposed in opposition to the photo-sensitive member mounted at a predetermined position within the electrophotographic copying machine in juxtaposition to each other in the direction transverse to the moving direction of the photo-sensitive member, one of the sensors being positioned to sense the density of the toner image having a reference density and formed in the blank region, and an electric means is provided for deriving a control signal differentially from the electrical output signals produced by the sensors. In another embodiment of the invention, an optical density detecting sensor is disposed in opposition to the photo-sensitive member of the electrophotographic copying apparatus at a position to sense the density of the reference toner image formed in the blank region of the photosensitive member, and a sensor control circuit is provided to vary the electric output of the sensor until a predetermined level has been attained while the sensor is effecting the density detection at the blank region outside of the reference toner image.

In the following, the present invention will be described in detail in conjunction with preferred embodiments thereof by referring to the accompanying drawings.

DETAILED DESCRIPTION OF THE PREFERRED EMBODIMENTS

Figure 1:
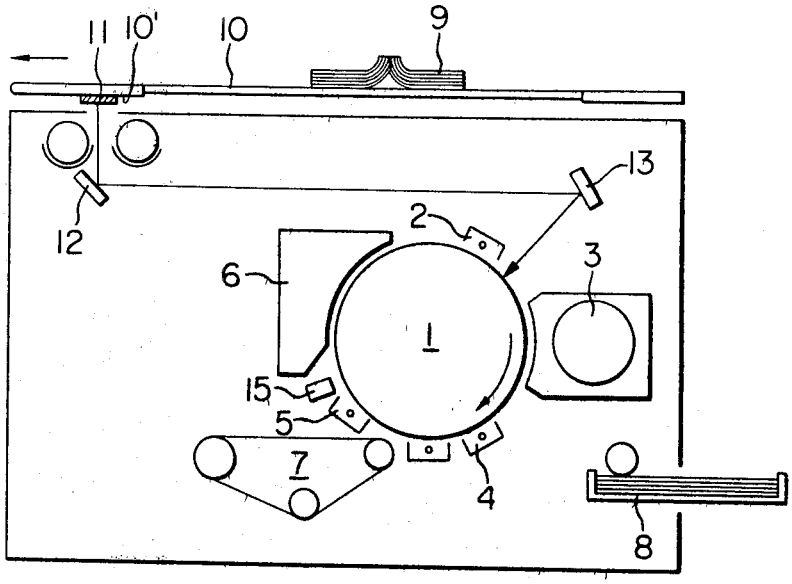
FIG. 1 shows schematically a general arrangement of an electrophotographic copying apparatus to which the principle of the invention can be applied.

Referring to FIG. 1, which shows a general arrangement of an electrophotographic copying apparatus having a movable copy board, the copying apparatus includes a rotatable drum 1 adapted to be rotated in the direction indicated by an arrow and having a photo-sensitive layer thereon. Disposed around the outer periphery of the drum 1 are a charging electrode 2, a developing device 3, a transfer electrode 4, an electric charge removing electrode 5 and a cleaning device 6 which are arrayed in this order as viewed in the rotating direction of the photo-sensitive drum 1. A copy sheet transporting mechanism 7 is disposed below the developing and transferring mechanism described above. The copy sheets stacked in a container 8 are individually and successively supplied in accordance with the copying operation. A copy board 10 for supporting thereon an original to be copied is disposed at the top portion of the copying apparatus and is adapted to be moved in the direction indicated by an arrow. A patch 11 having a predetermined density is attached to the lower surface 10' of the copy board 10. The patch 11 is provided by a rectangular or square thin plate in a size of about 4 $cm^2$ having a predetermined optical density usually in the range of 0.5 to 1.0. In the developing process, the toner image of this patch 11 is formed on the photo-sensitive drum 1 through mirrors 12 and 13 and is utilized as a reference for correctively modifying the density of the toner image of the original in a manner described in detail hereinafter. Reference numeral 15 denotes a sensor for measuring the density of the toner image of the patch 11 produced on the photo-sensitive drum 1. The sensor 15 is usually positioned between the developing device 3 and the cleaning device 6. However, in the case of the illustrated embodiment shown in FIG. 1, the sensor 15 is disposed between the charge removing electrode 5 and the cleaning device 6, because the sensor 15 is intended to serve the additional function of detecting a jammed state of the copy sheets.

Figure 2:
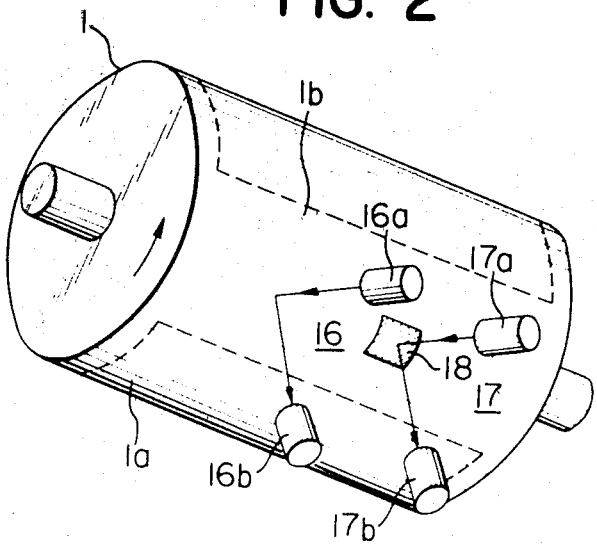
FIG. 2 is a perspective view showing an image density detecting device according to an embodiment of the invention.

FIG. 2 shows an exemplary embodiment of an image density detecting system according to the invention.

The image density detecting system comprises a pair of sensors 16 and 17 such as a photo-diode and photocell disposed in the vicinity of the photo-sensitive drum 1, wherein each of the sensors 16 and 17 is composed of a light emitter or transmitter element and a light receiving element. More particularly, the sensor 16 is constituted by a light emitter element **16*a* and a light receiver element 16*b*, while the sensor 17 is constituted by a light emitter element 17*a* and a light receiver element 17*b*. The light emitter element is provided to radiate light in a predetermined direction. On the other hand, the light receiver element is adapted to receive light radiated by the energized emitter element 17*a* and reflected from the drum surface and to produce an output voltage or current signal of a magnitude proportional to the quantity of light impinging on the light receiver sensors. Since such elements and sensor are per se known in the art and commercially available and do not constitute an essential part of the invention, further description will be unnecessary. As can be seen from FIG. 2, the surface of the photo-sensitive drum 1 is divided into an image region 1*a* in which the image of the original 9 is to be produced and a remaining blank region 1*b* in which no image of the original 9 is formed. It is to be noted that the blank region 1*b* is utilized for detecting the toner density or concentration. To this end, a reference toner image 18 of the patch 11 attached to the lower surface 10' of the copy board 10 is produced in the blank region 1*b*. The reference toner image 18 of the patch 11 may be formed at any given location in the blank region 1*b*. The first sensor 16 is not associated with the toner image 18 of the patch 11 but the second sensor 17 is used in association with the reference toner image 18. More specifically, the first sensor 16 is intended for detecting the density of the blank region 1*b* itself, while the second sensor 17 is adapted to detect the density of the reference toner image 18. It is self-explanatory that the light emitter elements 16*a*, 17*a* and the light receiver elements 16*b*, 17*b* are arrayed in accordance with the functions of the respective sensors 16 and 17 described above. Furthermore, it is preferred that both the sensors 16 and 17** are disposed as close as possible to each other so that any contamination by toner particles occurs to substantially the same degree for both sensors.

Another exemplary embodiment of the image density detecting system according to the present invention is schematically illustrated in FIGS. **3*a* and 3*b*. In these figures, the same reference numerals as those used in FIG. 2** denote like component parts.

Figure 3A:
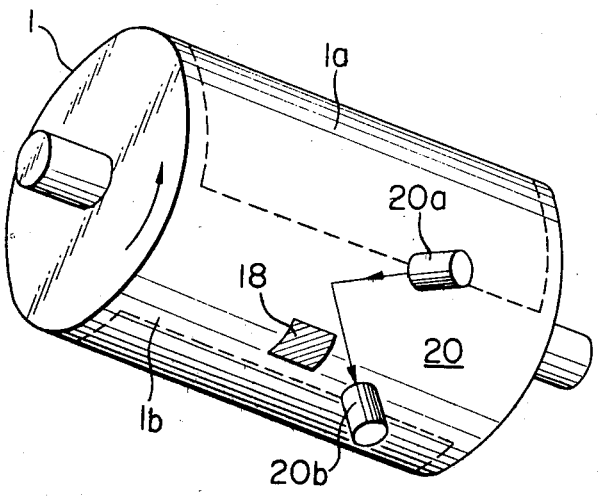
FIGS. 3*a* and 3*b* are perspective views showing an image density detecting device according to another embodiment of the invention in different operating states.

The image density detecting system shown in FIGS. **3*a* and 3*b* comprises a single sensor 20 and thus differs in this respect from the construction of the detecting system described hereinbefore in conjunction with FIG. 2. The sensor 20 is constituted by a light emitter element 20*a* such as a photo-diode and by a light receiver element 20*b* such as a photocell, both of which are disposed in the proximity of the photo-sensitive drum 1. The light emitter element 20*a* is so positioned that the radiation produced therefrom will impinge on a moving path of the reference toner image 18, while the light receiver element 20*b* is so positioned that the light radiation projected from the light emitter element 20*a* and reflected from the drum surface may impinge onto the receiver element 20*b*. FIG. 3*a* shows the state in which the sensor 20 is in position to detect the density of the blank region 1*b* outside of the reference toner image 18, while in the state shown in FIG. 3*b* the sensor is in position to detect the density of the reference toner image 18 after a rotation of the drum 1 through a corresponding angle from the position shown in FIG. 3*a***. It should be understood that the sensor is operated only while the blank region including the reference toner image is presented for measurement.

Figure 4:
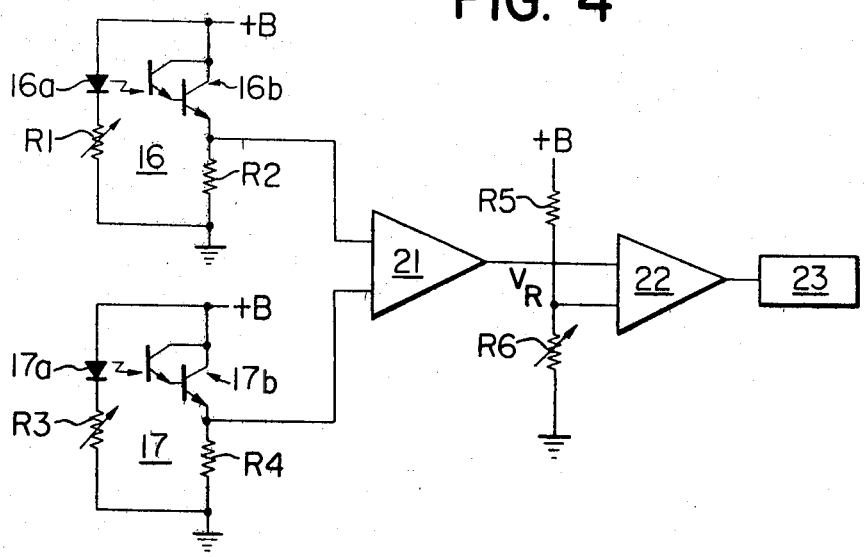
FIG. 4 is a circuit diagram showing an image density detecting circuit according to the invention which is to be used in combination with the device shown in FIG. 2.
Figure 5:
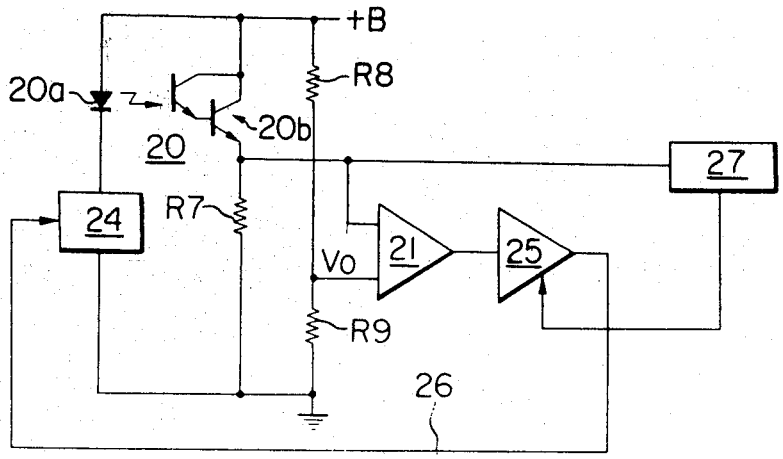
FIG. 5 is a circuit diagram showing an image density detecting circuit according to the invention which is to be used in combination with the device shown in FIGS. 3*a* and 3*b*.

Next, description will be set forth of the operations of the image density detecting systems according to the invention by referring to FIGS. 4 and 5.

Referring first to FIG. 4 which shows a density detecting circuit to be used in combination with the sensor system shown in FIG. 2, the light emitter element **16*a* of the first sensor 16 is connected in series with a variable resistor R1 and the corresponding receiver element 16*b* is connected in series with a sensor output resistor R2. Both of these series circuits are connected in parallel to each other between a power source +B and ground. In a similar manner, the light emitter element 17*a* of the second sensor 17 is connected in series with a variable resistor R3 for adjusting the sensitivity, while the light receiver element 17*b* is connected in series with a sensor output resistor R4. In this case, both of the series circuits are also connected in parallel with each other between the power source +B and ground. The outputs from the sensors 16 and 17 are connected to a differential amplifier circuit 21, the output of which is in turn connected to one of the input terminals of a comparator circuit 22. The other input terminal of the comparator circuit 22 is connected to the junction between a fixed resistor R5 and a variable resistor R6 so that a preselected reference voltage $V_R$ as determined by the dividing ratio established by the resistors R5 and R6 is applied to the other terminal of the comparator circuit. The output terminal of the comparator circuit 22 is connected to a toner supplementing and jam detecting device 23** (hereinafter referred to as the toner supplementing control circuit) for supplying toner and for stopping operation of the machine.

Referring to FIG. 1, when the copying operation is initiated the photo-sensitive drum 1 starts rotating and the drum 1 undergoes electrical charging, exposure to a light image of an original 9 to be copied, and developement of the latent image at the developing device 3, whereby a copied image (toner image) of the original 9 is formed in the image region 1*a* with the reference toner image 18 of the patch 11 being produced in the blank region 1*b*. As the drum 1 is further rotated, the copied image of the original 9 produced on the photo-sensitive drum 1 is transferred to the copy sheet under the electric field action of the transfer electrode 4. However, the reference toner image 18 of the patch 11 remains on the blank region of the photo-sensitive drum 1, whereby the density of the reference toner image 18 is measured by the second sensor 17, as illustrated in FIG. 2. More particularly, and referring to FIG. 2, the light radiation from the light emitter element 16*a* of the first sensor 16 is reflected at the peripheral surface of the drum 1 and received by the light receiver element 16*b*, as a result of which a current of a magnitude proportional to the quantity of light received by the light receiving element 16*b* will flow through the output resistor R2 to produce a voltage drop thereacross which is then supplied to the differential amplifier circuit 21 as the output voltage signal from the sensor 16. On the other hand, the light radiation from the light emitter element 17*a* of the second sensor 17 is reflected by the reference toner image and received by the light receiving element 17*b*, resulting in a current of a magnitude corresponding to the quantity of light impinging on the element 17*b* flowing through the output resistor R4 to produce a voltage drop thereacross which is then supplied to the differential amplifier circuit 21 as the output voltage signal from the sensor 17. Since the output signal from the differential amplifier circuit 21 represents the difference between the outputs from the first and the second sensors 16 and 17, the output signal of the differential amplifier 21 will contain no components affected by the contamination of the sensors and by variations in the state of the photo-sensitive surface of the drum 1. Possible inequality in the sensitivity of the individual sensors can be initially compensated by correspondingly adjusting the variable resistors R1 and R3 so as to adjust the sensitivity. In this manner, the output signal from the differential amplifier circuit 21 represents the true or pure density of the reference toner image 18 and hence the toner density or concentration, without being influenced by contamination of the sensors and the surface conditions of the photo-sensitive drum 1. The output signal from the differential amplifier circuit 21 is supplied to the comparator circuit 22 to be compared with the reference voltage $V_R$ which is preset through adjustment of the variable resistor R6 so that an optimum toner concentration for the desired density of the copied image can be attained. When the toner concentration is decreased, the density of the reference toner image is correspondingly reduced, as a result of which the quantity of light impinging on the photo-sensitive element 17*b* of the second sensor 17 is increased to thereby correspondingly increase the output voltage of the sensor 17. Consequently, the output voltage from the differential amplifier circuit 21 will be increased beyond the reference voltage level $V_R$. Then, the comparator circuit 22 produces an output signal which is utilized for initiating the toner supplying operation under the control of the toner supplementing control circuit 23 connected to a toner supply box as is well known. The toner supplying operation continues until the output voltage from the comparator circuit 22 has become zero through repeated copying operations; i.e. until the density of the reference toner image 18 has increased to a value at which the output voltage becomes lower than the reference voltage $V_R$ due to the correspondingly lowered output voltage from the second sensor 17.

The first and the second sensors 16 and 17 are intended to perform the function of detecting the jamming state of the copy sheets in addition to the function of detecting the density of the reference toner image described above. Both of these functions can be performed in an appropriate manner by activating the toner supplementing control circuit 23 in a predetermined sequence associated with the copying operation.

Figure 3B:
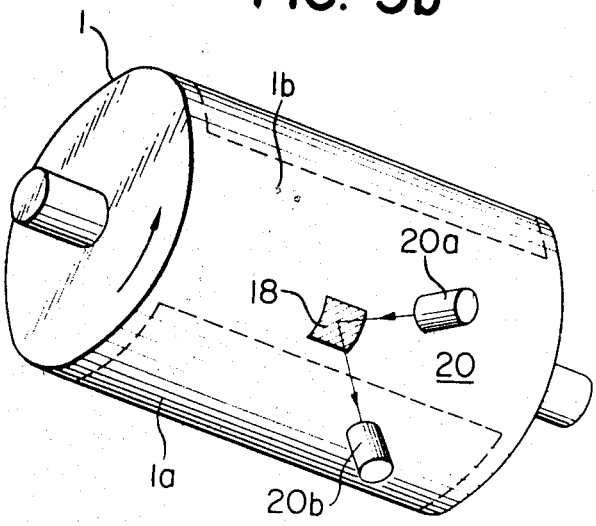

FIG. 5 is a circuit diagram showing a density detecting circuit to be employed in combination with the sensor system shown in FIGS. 3*a* and 3*b*. Referring to FIG. 5, the light emitter element 20*a* of the sensor 20 is connected in series with a sensor control circuit 24, while the light receiver element 20*b* is connected in series with a sensor output resistor R7. Both of these series circuits are connected in parallel to each other between a power supply source +B and ground. The output of the sensor 20 is connected to one input terminal of a differential amplifier circuit 21 which has the other input terminal connected to the junction of voltage dividing resistors R8 and R9 which are in turn connected in series with each other between the power source +B and ground. The output from the sensor 20 is coupled also to an input terminal of a toner supplementing control device 27. In the case of the exemplary embodiment being now described, it is assumed that the toner supplementing control device 27 includes the resistors R5 and R6 and the comparator circuit 22 both shown in FIG. 4 but not shown in this drawing. The output terminal of the differential amplifier circuit 21 is connected to a sample and hold circuit 25, the output terminal of which in turn is connected to a control terminal of the sensor control circuit 24 through a control line 26. It will be noted that the sample and hold circuit 25, the control line 26 and the sensor control circuit 24 constitutes a feedback loop.

In operation, the density of the blank region 1*b* outside of the reference toner image 18 on the peripheral photo-sensitive surface of the drum 1 is at first detected or sensed by the sensor 20. The light radiation from the light emitter element 20*a* of the sensor 20 is reflected at the drum surface and impinges onto the light receiver element 20*b*, as a result of which a current proportional to the quantity of received light will flow through the output resistor R7 to produce a voltage drop thereacross, which is then supplied to the differential amplifier circuit 21. On the other hand, a reference voltage Vo preselected by the voltage dividing resistors R8 and R9 is applied to the other input of the differential amplifier circuit 21. Consequently, the output signal of the differential amplifier circuit 21 represents the difference between the output voltage of the sensor 20 and the preselected reference voltage Vo. The difference of the output signals is then supplied to the sample and hold circuit 25, the output of which is supplied through the line 26 to the sensor control circuit for correspondingly varying the impedance of the sensor control circuit 24. In this mode, the sample and hold circuit 25 serves merely as an amplifier. It should be mentioned that control is effected such that the impedance of the sensor control circuit 24 is decreased as the output voltage from the sample and hold circuit 25 is increased. In this way, the impedance of the sensor control circuit 24 is decreased until the output voltage of the sensor 20 has become equal to the preset reference voltage Vo, to thereby increase the current flowing through the light emitter element 20*a* and correspondingly increase the quantity of light produced by the element 20*a*. The sensor control circuit may be composed of a transistor having a base electrode connected to the control terminal. When the output voltage of the sensor has attained the level of the preset voltage Vo, the impedance of the sensor control circuit 24 is maintained at a constant value due to the holding function of the sample and hold circuit as triggerred by a signal supplied from the toner supplementing control device 27. Consequently, the light emitter element 20*a* is maintained at a constant emission level. The holding interval may be selected in a rather arbitrary manner and may be set equal to a single copying cycle or other periods as required. In this manner, the output voltage from the sensor 20 is held at the preset voltage level Vo until the drum 1 has attained the position at which the reference toner image 18 is irradiated with light emitted from the light emitter element 20*a*, as is shown in FIG. 3*b*. The quantity of light emitted by the light emitter element 20*a* under the control described above is corrected with respect to all of the factors which might possibly influence the accuracy of the toner density measurement such as sensitivity of the sensor, temperature characteristics of the sensor, contamination of the sensor, distance between the sensor and the photo-sensitive drum, and variations in the surface conditions of the drum.

In this state, density detection of the reference toner image 18 is performed by the sensor 20 in a manner similar to the case of the second sensor 17 described hereinbefore in conjunction with FIG. 2, whereby the output signal from the sensor 20 is fed to the toner supplementing control device 27 to thereby control the initiation or termination of the supply of toner to the developing device. In the case where the sensor 20 is used for detecting the possible jamming of copy sheets in addition to density detection, both of these functions can be executed in a satisfactory manner by selectively activating the toner supplementing control device 27 and the mechanisms associated with jamming detection by correspondingly programming the sequence of the copying operation. The exemplary embodiment shown in FIG. 3 and FIG. 5 is fundamentally different from the one described hereinbefore in conjunction with FIGS. 2 and 4 in that only one sensor is required and thus is advantageous over the latter with respect to manufacturing costs and spatial requirements. A further important advantage can be seen in that temperature compensation of the electric elements such as the sensor used in the density detecting system can be automatically effected to allow the density detection to be attained with an enhanced accuracy. Such advantage is very significant in view of the fact that the temperature in an electrophotographic copying machine undergoes considerable variations.

In the foregoing description, it has been assumed that the light radiation reflected at the peripheral surface of the photo-sensitive drum is utilized. However, it is within the contemplation of the invention that at least a portion of the photo-sensitive drum may be made of a transparent organic photo-sensitive material such as polyvinylcarbazole and that light radiation transmitted through the photo-sensitive drum may be utilized for the density detection.

What is claimed is:

1. An apparatus for detecting image density in an electrophotographic copying machine having an operatively movable photosensitive member, comprising:

a first optical density detecting sensor for detecting the density of a blank region on the photosensitive member in which region no toner image of an original to be copied is formed and for producing a first output signal in accordance with the detected density;

a second optical density detecting sensor for detecting the density of a reference toner image formed on a portion of the blank region and for producing a second output signal in accordance with the detected density of the reference toner image;

said first and second optical density detecting sensors being disposed in opposition to the photosensitive member and positioned in juxtaposition to each other in the direction transverse to the direction of movement of the member; and electrical means for receiving said first and second output signals and for differentially producing a control signal in accordance therewith for enabling a control of image density.

2. A method of controlling the density of an image of an original to be copied in an electrophotographic copying machine utilizing toner fed from a developing device which includes a photosensitive member for receiving thereon an image of an original at a predetermined region on the member, said method comprising the steps of:

operating a first detector to measure the density of a blank region on the photosensitive member and to produce a first output signal in accordance with the measured density, said blank region being located in an area on the member remote from said predetermined original image region;

operating a second detector to measure the density of a reference toner image formed in the blank region and to produce a second output signal in accordance with the measured density of the reference patch;

comparing the measured densities of the blank region and of the reference toner image by comparing the first and second output signals and producing a comparison signal in accordance therewith; and controlling the density of the developed image of an original by selective addition of toner to the developing device in accordance with the comparison signal.

3. A method according to claim 2 wherein said comparison further comprises comparing the comparison signal with a reference signal of predetermined value.

* * * * *